US012747642B2

(12) United States Patent
Brackin et al.

(10) Patent No.: US 12,747,642 B2
(45) Date of Patent: Sep. 29, 2026

(54) ACTIVE TORSIONAL ISOLATOR AND DAMPER

(71) Applicant: Halliburton Energy Services, Inc., Houston, TX (US)

(72) Inventors: Van Jordan Brackin, Conroe, TX (US); Andrew D. Lake, Conroe, TX (US); Bradley David Dunbar, The Woodlands, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/498,868

(22) Filed: Oct. 31, 2023

(65) Prior Publication Data

US 2025/0137330 A1 May 1, 2025

(51) Int. Cl.
*E21B 17/07* (2006.01)

(52) U.S. Cl.
CPC ..... *E21B 17/073* (2013.01); *E21B 17/076* (2013.01)

(58) Field of Classification Search
CPC ..... E21B 17/07; E21B 17/073; E21B 17/076
See application file for complete search history.

(56) References Cited

U.S. PATENT DOCUMENTS 6,364,039 B1 * 4/2002 Majkovic ..... E21B 17/073 175/320
7,036,612 B1 * 5/2006 Raymond ..... F16F 9/535 175/320
7,377,339 B2 * 5/2008 Wassell ..... E21B 17/073 175/323
7,748,474 B2 * 7/2010 Watkins ..... E21B 28/00 175/57
8,087,476 B2 * 1/2012 Wassell ..... E21B 17/07 175/57
9,784,046 B2 * 10/2017 Gajji ..... E21B 19/24
(Continued)

FOREIGN PATENT DOCUMENTS

GB 2443119 A * 4/2008 ..... E21B 17/07
GB 2443362 A * 4/2008 ..... E21B 17/07

OTHER PUBLICATIONS

Hanno, et al.; "New Generation Rotary Steerable Bottom Hole Assembly for ExtremeDrilling Dynamics Conditions"; Society of Petroleum Engineers DOI 10.2118/211788-MS; 2022; 19 pgs.

*Primary Examiner* — Jennifer H Gay
(74) *Attorney, Agent, or Firm* — Michael Jenney; Parker Justiss, P.C.

(57) ABSTRACT

An active system is provided that changes the mechanical stiffness of a BHA during drilling to prevent/reduce damage to a BHA due to vibrations. The active system uses a combination of mechanical and electronic systems to change the physical characteristics of a BHA that govern the natural frequencies thereof. The active system can change the mechanical stiffness of a BHA by switching between two different coupling modes for connecting sections or portions of the BHA. An active torsional isolator and damper (ATID) can be used to switch between the different coupling modes. In one example, the ATID includes: (1) a dynamic coupler configured to connect a first portion of a BHA to a second portion of the BHA according to different coupling modes, and (2) a processor configured to control switching of the dynamic coupler between the different coupling modes during a drilling operation of a drill bit.

11 Claims, 9 Drawing Sheets

(56) References Cited

U.S. PATENT DOCUMENTS 9,976,360 B2 * 5/2018 Wassell ..... E21B 17/07
10,047,573 B2 * 8/2018 Kadam ..... F16D 3/12
11,199,052 B2 12/2021 Lake
11,905,820 B2 * 2/2024 Volgmann ..... F16F 15/173
11,993,985 B2 * 5/2024 Crowley ..... E21B 17/073
12,270,258 B2 * 4/2025 Peters ..... E21B 17/076
12,276,164 B2 * 4/2025 Shen ..... E21B 17/10
12,421,810 B2 * 9/2025 Cayeux ..... E21B 17/07
2007/0284148 A1 * 12/2007 Wassell ..... E21B 17/073
175/371
2007/0289778 A1 * 12/2007 Watkins ..... E21B 28/00
175/40
2010/0139977 A1 * 6/2010 Watkins ..... E21B 44/00
175/56
2010/0224410 A1 * 9/2010 Wassell ..... E21B 17/07
175/57
2011/0120772 A1 * 5/2011 McLoughlin ..... E21B 17/10
175/56
2011/0198126 A1 * 8/2011 Swietlik ..... E21B 17/07
175/320
2012/0085581 A1 * 4/2012 Wassell ..... E21B 17/07
175/57
2014/0151122 A1 * 6/2014 Venugopal ..... E21B 17/073
175/40
2015/0259989 A1 * 9/2015 Gajji ..... E21B 19/24
175/56
2017/0030149 A1 * 2/2017 Kadam ..... F16D 3/80
2021/0079976 A1 * 3/2021 Peters ..... F16F 15/173
2021/0189806 A1 * 6/2021 Simanowski ..... F16F 15/173
2021/0189859 A1 * 6/2021 Volgmann ..... E21B 17/073
2023/0142360 A1 * 5/2023 Shen ..... E21B 17/10
175/57
2024/0084651 A1 * 3/2024 Crowley ..... E21B 17/073
2024/0309712 A1 * 9/2024 Crowley ..... E21B 17/073
2025/0027401 A1 * 1/2025 DiFoggio ..... F16F 15/002
2025/0034957 A1 * 1/2025 Cayeux ..... E21B 17/073
2025/0075568 A1 * 3/2025 Reckmann ..... E21B 17/07
2025/0137330 A1 * 5/2025 Brackin ..... E21B 17/076

* cited by examiner

ACTIVE TORSIONAL ISOLATOR AND DAMPER

TECHNICAL FIELD

The disclosure generally relates to drilling a borehole and, more specifically, to mitigating torsional oscillations during drilling of wellbores.

BACKGROUND

Accessing hydrocarbon reserves, such as gas or oil reserves, typically involves creating a wellbore by drilling into the earth using a drill bit. The drill bit is part of a bottom hole assembly (BHA) located at the downhole end of a drill string, which includes multiple drill pipes connected together. In addition to the drill bit, the BHA includes other components, such as stabilizers, drill collars, measuring equipment or sensors, and directional drilling equipment. A key driver that impacts drilling performance is the severity and the types of vibrations encountered by the BHA and other downhole tools during the drilling job. High Frequency Torsional Oscillations (HFTO), for example, is a torsional dysfunction that occurs during drilling. The HFTO dysfunction mode is a "torsional ringing" of the BHA at one or more of the BHA's natural frequencies due to drilling noise at the bit-rock interface, such as when drilling a hard rock formation with a Polycrystalline diamond compact (PCD) bit.

BRIEF DESCRIPTION

DETAILED DESCRIPTION

Figure 1:
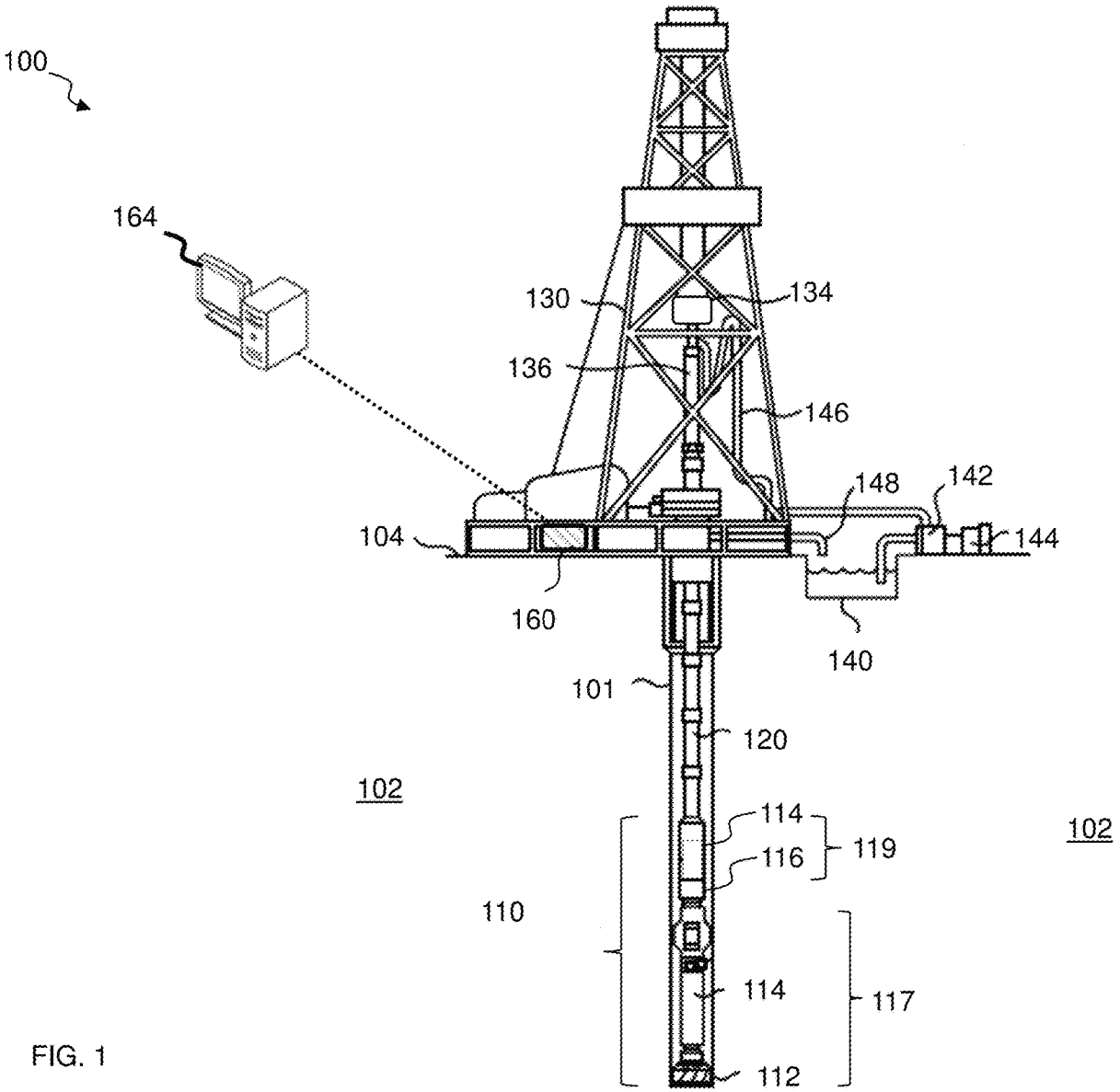
FIG. 1 is an example of a drilling system configured to perform formation drilling to create a wellbore according to the principles of the disclosure.

HFTO, while not damaging to the drill bits, can cause severe damage to drilling systems, such as a BHA. The high cyclic torsional loads can fatigue mechanical components within a BHA, which can result in cracks and tool failures. In addition to damaging mechanical components, the high cyclic torsional loads from HFTO can also damage electronic components and sensors of a BHA.

To prevent or at least reduce damage to a BHA due to vibrations such as from HFTO, the disclosure provides an active system that changes the mechanical stiffness of a BHA during drilling. The disclosed active system uses a combination of mechanical and electronic systems to change the physical characteristics of a BHA that govern the natural frequencies of the BHA. The active system can change the mechanical stiffness of a BHA by switching between two different coupling modes for connecting sections or portions of the BHA. An active torsional isolator and damper (ATID) can be used to switch between the different coupling modes, which can be, for example, a rigid mode and a relaxed mode. A rigid coupling mode, or simply rigid mode, provides a stiffer connection between the BHA sections than the relaxed coupling mode, or simply relaxed mode. The torsional rigidity provided in the rigid mode is due to restricting relative movement between the two different portions of the BHA that are coupled together. Switching between the different coupling modes changes the mass of the BHA and prevents the BHA from going into resonance for the difference modes. Accordingly, the ATID switches between the different modes based on a time interval that is less than an amount of time needed to achieve resonance (referred to herein as a resonance time interval) in the particular modes. Switching between a rigid mode and a relaxed mode can occur in less than one second when addressing HFTO.

For example, when in a rigid mode the BHA may have a primary natural frequency of 58 Hz. As such, under certain conditions the BHA can experience HFTO at 58 Hz. The conditions can include, for example, rock type, bit design, and operating parameters. A switch to a relaxed mode with natural frequencies of 75 an 105 Hz will cause the BHA to vibrate at those frequencies. However, since one to ten seconds may be needed for HFTO to full develop in either of the modes, switching between the rigid and relaxed modes at a shorter time period, such as less than one second, will prevent the BHA from going into resonance in either of the modes. Thus, instead of a passive system used in conventional mitigation schemes that attempt to isolate or damp certain frequencies within a BHA using isolators, dampers, or a combination thereof, the disclosed system is configured to actively change the physical stiffness of a BHA using different coupling modes and allow the BHA's own mass to damp the damaging vibrations before resonance can occur.

Advantageously, the active system reduces the need to limit operating parameters in damaging vibration environments, such as HFTO environments, to limit damage to BHAs. The disclosed active system can allow drilling with higher energy compared to other drilling systems without damaging mechanical and electronic components of a BHA; especially in hard rock formations. As such, the ROP can increase and drilling costs can decrease.

In the drawings and descriptions that follow, like parts are typically marked throughout the specification and drawings with the same reference numerals, respectively. The drawn figures are not necessarily to scale. Certain features of the disclosure may be shown exaggerated in scale or in somewhat schematic form and some details of certain elements may not be shown in the interest of clarity and conciseness. The present disclosure may be implemented in embodiments of different forms.

Specific embodiments are described in detail and are shown in the drawings, with the understanding that the present disclosure is to be considered an exemplification of the principles of the disclosure, and is not intended to limit the disclosure to that illustrated and described herein. It is to be fully recognized that the different teachings of the embodiments discussed herein may be employed separately or in any suitable combination to produce desired results.

Unless otherwise specified, use of the terms "connect," "engage," "couple," "attach," or any other like term describing an interaction between elements is not meant to limit the interaction to direct interaction between the elements and may also include indirect interaction between the elements described. Unless otherwise specified, use of the terms "up," "upper," "upward," "uphole," "upstream," or other like terms shall be construed as generally away from the bottom, terminal end of a well, regardless of the wellbore orientation; likewise, use of the terms "down," "lower," "downward," "downhole," "downstream," or other like terms shall be construed as generally toward the bottom, terminal end of a well, regardless of the wellbore orientation. Use of any one or more of the foregoing terms shall not be construed as denoting positions along a perfectly vertical axis. In some instances, a part near the end of the well can be horizontal or even slightly directed upwards. Unless otherwise specified, use of the term "subterranean formation" shall be construed as encompassing both areas below exposed earth and areas below earth covered by water such as ocean or fresh water.

FIG. 1 illustrates a drilling system 100 configured to perform formation drilling to create a wellbore 101 according to the principles of the disclosure. The system 100 can be, for example, a logging-while-drilling (LWD) system or a measurement-while-drilling (MWD) system. FIG. 1 depicts an onshore operation. Those skilled in the art will understand that the disclosure is equally well suited for use in offshore operations or onshore operations over a body of water.

The drilling system 100 includes a BHA 110 coupled to a drill string 120. The BHA 110 includes a drill bit 112, which can be moved axially within the wellbore 101. The system 100 is configured to drive the BHA 110 positioned or otherwise arranged at the bottom of the drill string 120 that is extended into the earth 102 from a derrick 130 arranged at the surface 104. The system 100 also includes a top drive 134 that is used to rotate the drill string 120 at the surface 104, which then rotates the drill bit 112 in the wellbore 101. Operation of the top drive 134 is controlled by a top drive controller (not shown). The system 100 also includes a kelly 136 and can include a traveling block (not shown) that is used to lower and raise the kelly 136 and drill string 120.

Fluid or "drilling mud" from a mud tank 140 may be pumped downhole using a mud pump 142 powered by an adjacent power source, such as a prime mover or motor 144. The drilling mud may be pumped from mud tank 140, through a stand pipe 146, which feeds the drilling mud into drill string 120 and conveys the same to the drill bit 112. The drilling mud exits one or more nozzles arranged in the drill bit 112 and in the process cools the drill bit 112. After exiting the drill bit 112, the mud circulates back to the surface 104 via the annulus defined between the wellbore 101 and the drill string 120, and in the process, returns drill cuttings and debris to the surface. The cuttings and mud mixture are passed through a flow line 148 and are processed such that a cleaned mud is returned down hole through the stand pipe 146 once again.

The system 100 also includes a well site controller 160, and a computing system 164, which can be communicatively coupled to well site controller 160. Well site controller 160 includes one or more processors and one or more memories and is configured to direct operation of the system 100 using the processors and memories. Computing system 164 can be a laptop, smartphone, personal digital assistant (PDA), server, desktop computer, cloud computing system, other computing systems, or a combination thereof, that are operable to perform the processes and methods described herein for operating the system 100. Well site operators, engineers, and other personnel can send and receive data, instructions, measurements, and other information by various conventional means with computing system 164 or well site controller 160. Well site controller 160 or computing system 164, can be utilized to communicate with downhole tools of the BHA 110, such as sending and receiving telemetry, data, drilling sensor data, instructions, and other information, including but not limited to collected or measured parameters, location within the wellbore 101, and cuttings information. A communication channel may be established by using, for example, electrical signals or mud pulse telemetry for most of the length from the drill bit 112 to the controller 160.

As stated above, the drill bit 112 penetrates the earth 102 and thereby creates the wellbore 101. BHA 110 provides directional control of the drill bit 112 as it advances into the earth 102. A tool string 114 of the BHA 110 can include the downhole tools of the BHA 110. Accordingly, the tool string 114 can be semi-permanently mounted with various measurement tools (not shown) such as, but not limited to, MWD and LWD tools, that may be configured to take downhole measurements of drilling conditions and geological formation of the earth 102. The measurement tools can include sensors, such as magnetometers, accelerometers, gyroscopes, etc. As noted herein, the sensors can be used to detect the presence of harmful vibrations, such HFTO.

The BHA 110 can include another downhole tool, an ATID 116. The ATID 116 dynamically couples a first portion 117 of the BHA 110 to a second portion 119 of the BHA 110. In FIG. 1, the first portion 117 is denoted as the portion including the drill bit 112 and the second portion 119 is the upper portion towards the surface 104. The ATID 116 couples the first and second portions 117, 119, according to different coupling modes, such as a rigid and relaxed mode. The ATID 116 can actively switches between the different coupling modes during drilling to prevent the BHA 110 from going into resonance. Changing the coupling modes actively changes a resonance frequency of the BHA 110 during drilling by changing a stiffness of the connection between the portions 117 and 119, which allows the mass of the BHA 110 to damp vibrations, such as from HFTO. Placement of the ATID 116 along a length of the BHA 110 considers the natural frequencies of the BHA in both configurations of the rigid and relaxed coupling modes. A location of the ATID 116 can vary in different implementations depending on, for example, minimizing an overlap of the natural frequencies associated with each of the different coupling modes. The ATID 116 can include a dynamic coupler and one or more processors that controls switching between the different coupling modes. ATID 200 of FIG. 2 provides an example of the ATID 116.

Figure 2:
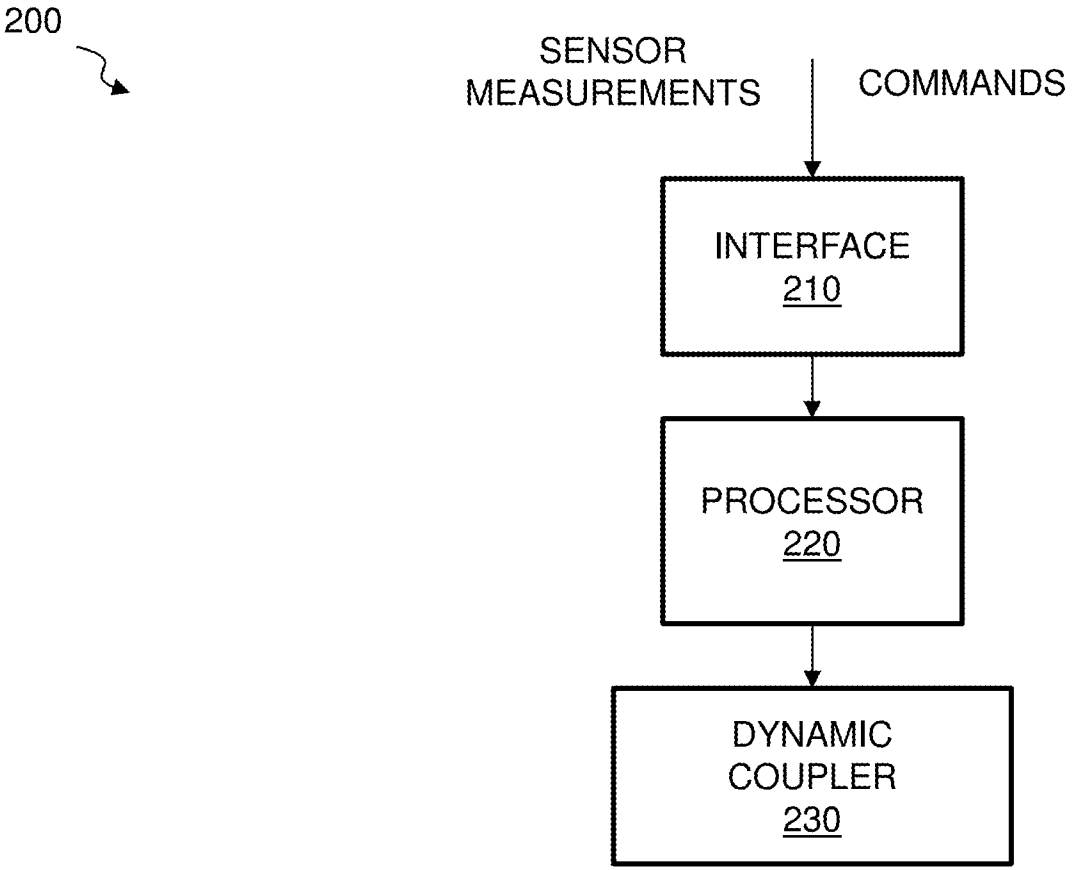
FIG. 2 is a block diagram of an example of an active torsional isolator and damper (ATID) constructed according to the principles of the disclosure.

FIG. 2 is a block diagram of an ATID 200 constructed according to the principles of the disclosure. The ATID 200 is configured to rapidly change coupling between different portions of a BHA to prevent resonance and possible damage to the BHA, such as BHA 110 of FIG. 1. The ATID 200 includes an interface 210, one or more processors represented by processor 220 and a dynamic coupler 230. The ATID 200 can include additional components, such as one or more memories that cooperate with the processor 220. The one or more memories can store one or more algorithms that direct operation of the processor 220 as disclosed herein.

The interface 210 is configured to receive sensor measurements from downhole sensors, such as downhole sensors of the BHA. The sensors can be conventional sensors that are used to determine vibrations in downhole tools. The sensor measurements can represent vibrations of the BHA. As such, the sensors can detect and report HFTO to the ATID 200 via the interface 210. The interface 210 can also receive commands, such as signals, from the surface to direct operation of the ATID 200. The interface 210 can be a conventional interface that includes the necessary components and logic to communicate signals in a downhole environment according to various communication protocols.

The processor 220 is configured to control switching of the dynamic coupler 230 between the different coupling modes during a drilling operation of the drill bit. The processor 220 can switch between the different coupling modes using a switching time interval that is less than a time interval for the BHA to achieve a resonance frequency associated with either of the different coupling modes. The resonance time interval can be determined based on modeling of the BHA using known data of the components of the BHA. The switching time interval can be fixed. For example, the switching time interval can be one second or less, or can be between one to two seconds. The switching time interval can be variable and be based on an indication of resonance in one of the coupling modes from the sensors. As such, the switching time interval can be an automatic variable interval based on a HFTO signature. Regardless if fixed or variable, the switching time interval can be of a duration to ensure resonance frequency does not occur for the BHA. The switching time interval can be dependent on a command, such as received from the surface.

In addition to the different coupling modes, the processor 220 can also place the dynamic coupler 230 in a normal coupling mode wherein the dynamic coupler 230 is in an inactive state and does not switch between the different coupling modes. A command from the surface can indicate when to operate in the normal coupling mode or the active coupling modes that include the rigid and relaxed modes. Additionally, the processor 220 can determine to operate in the different coupling modes based on the sensor measurements. The sensor measurements, the surface commands, or a combination thereof can be used to direct switching between the different coupling modes. The processor 220 is communicatively coupled to the interface 210 and the dynamic coupler 230.

The dynamic coupler 230 is configured to connect a first portion of the BHA to a second portion of the BHA using different coupling modes. The first portion can be a lower portion of the BHA that includes the drill bit and the second portion can be the remaining portion of the BHA. The dynamic coupler 230 includes an outer housing and an inner section that is located within the outer housing. The inner section is the lower portion and the outer housing is the remaining portion of the BHA. The outer housing can correspond to the outer surface of the communication bus of the BHA. Electronic components of the ATID 200, such as the interface 210 and the processor 220, can be located within the communication bus of the BHA.

Figure 3:
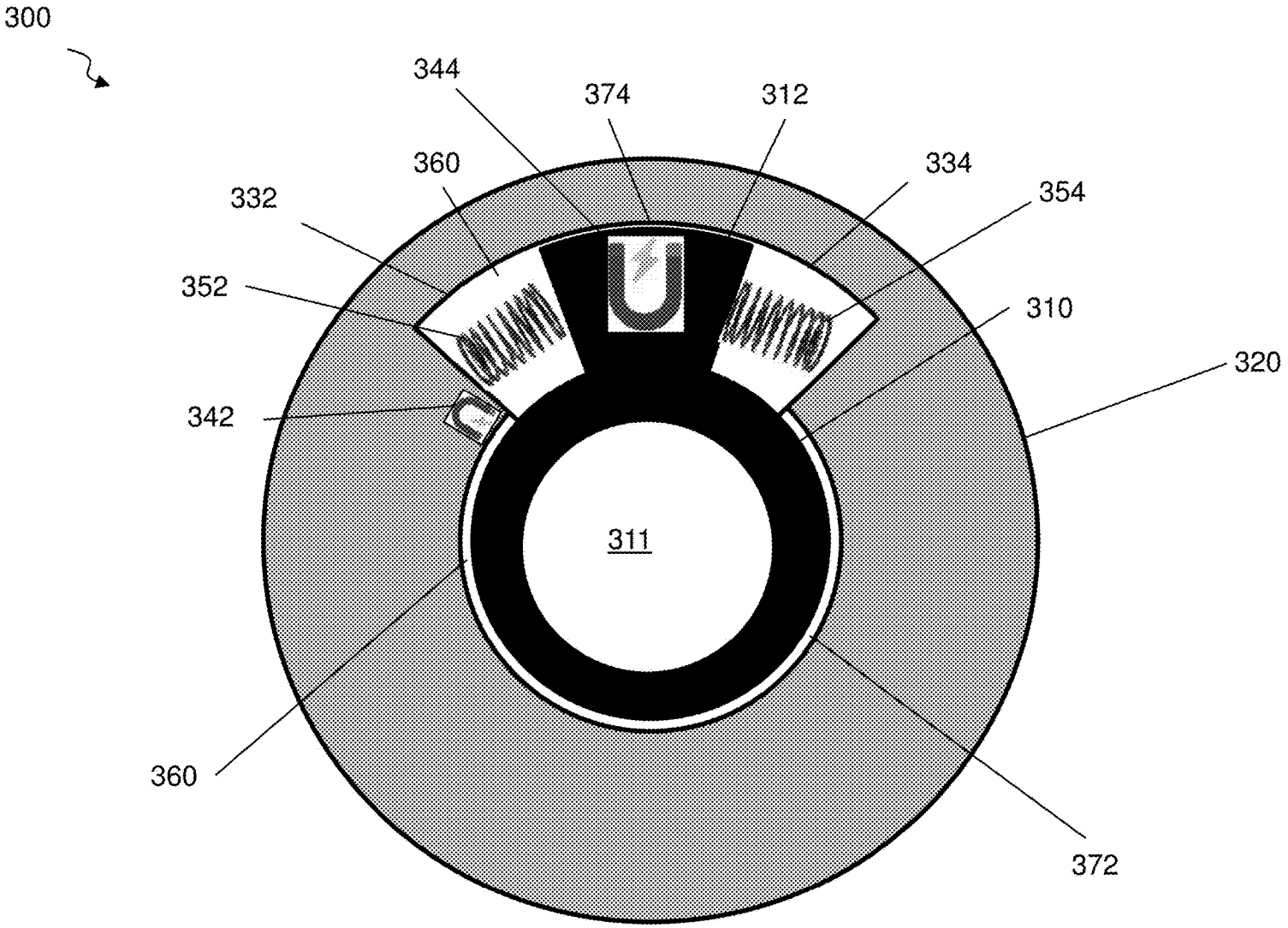
FIG. 3 is a cross section diagram of an example of a dynamic coupler constructed according to the principles of the disclosure.
Figure 4:
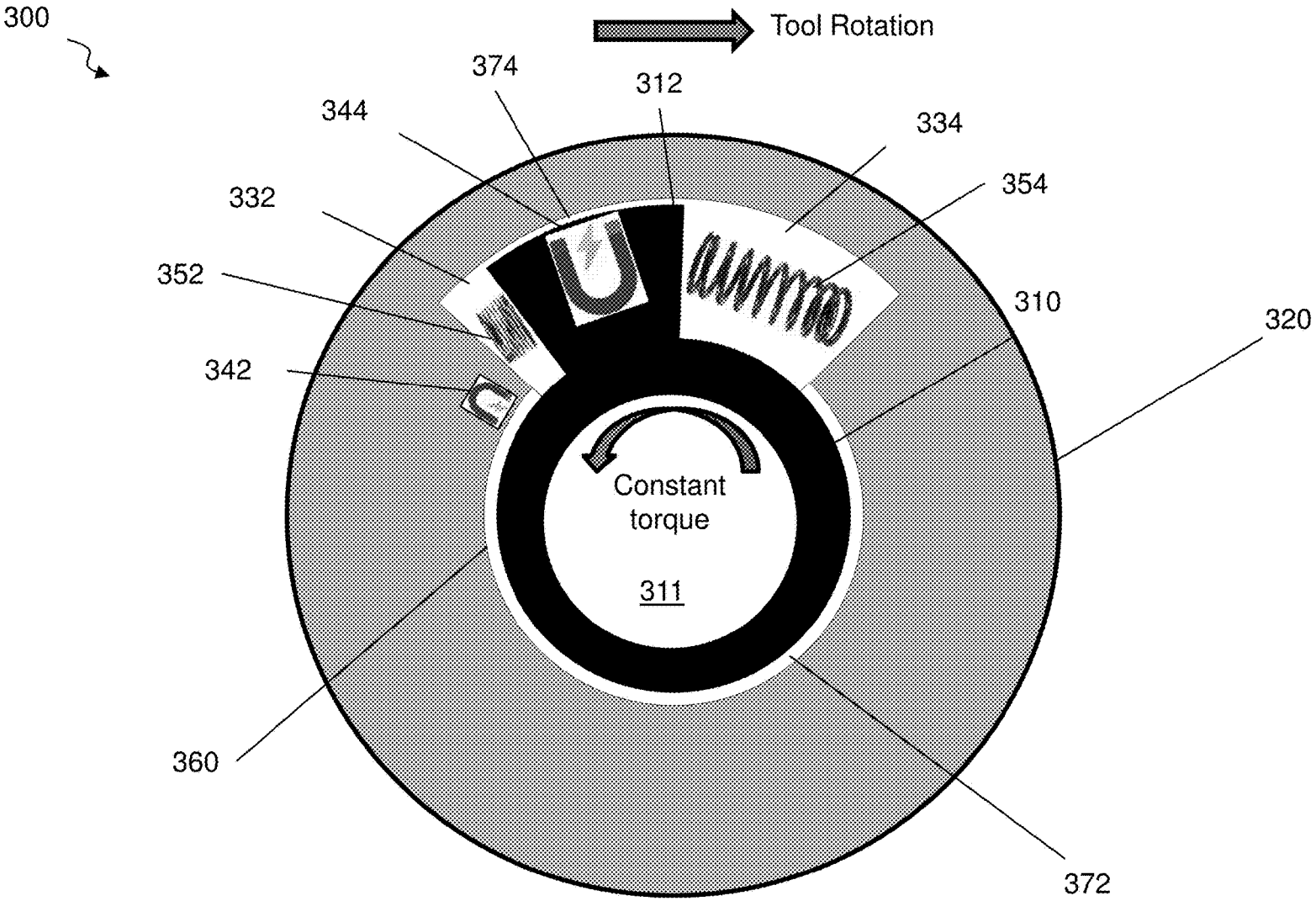
FIG. 4 is an example of the dynamic coupler of FIG. 3 being under constant torque.
Figure 5:
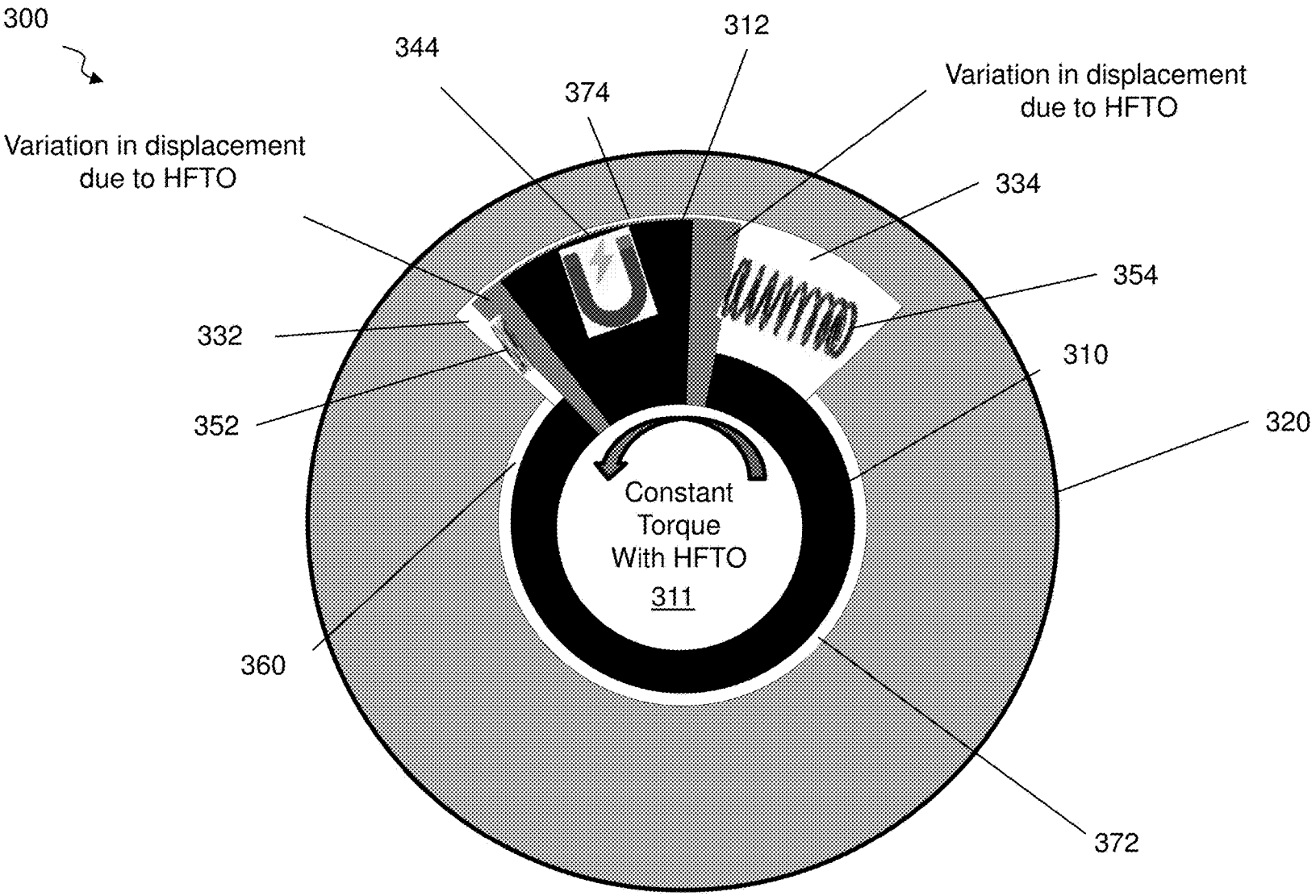
FIG. 5 is an example of the dynamic coupler of FIG. 3 being under the oscillating loads experienced when damaging vibrations occur.
Figure 6:
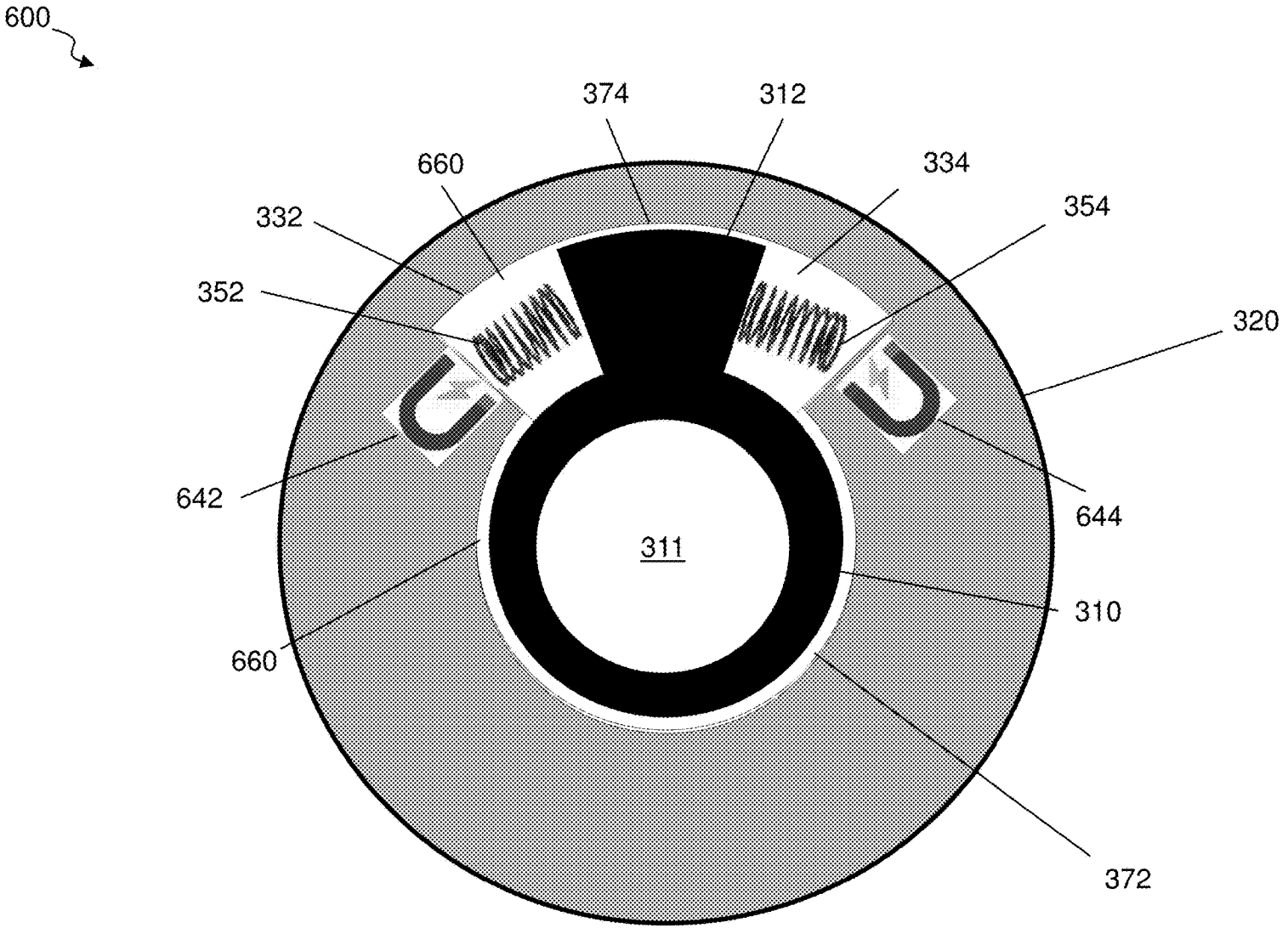
FIG. 6 is a cross section of another example of a dynamic coupler constructed according to the principles of the disclosure.
Figure 7:
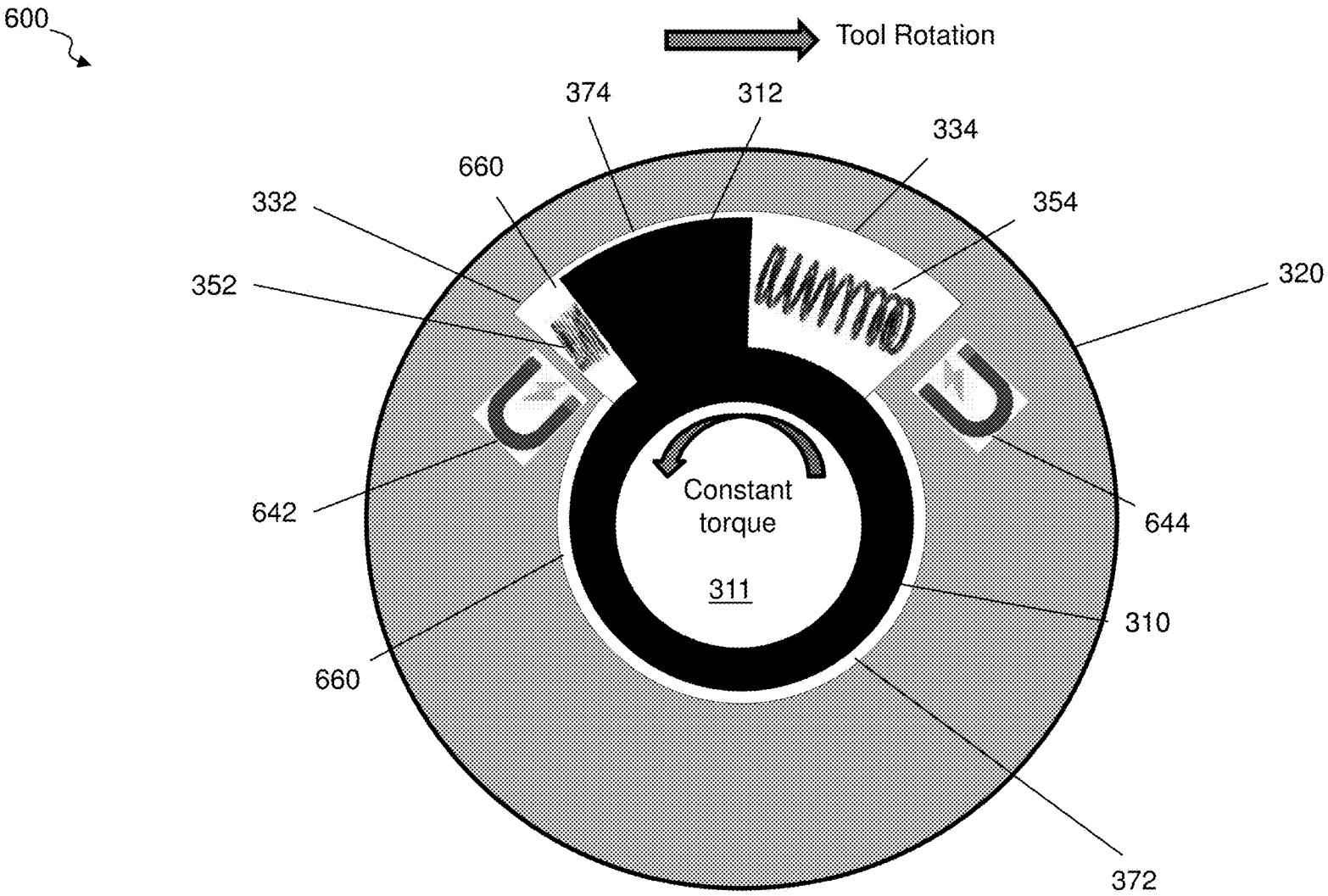
FIG. 7 is an example of the dynamic coupler of FIG. 6 in a rigid mode.
Figure 8:
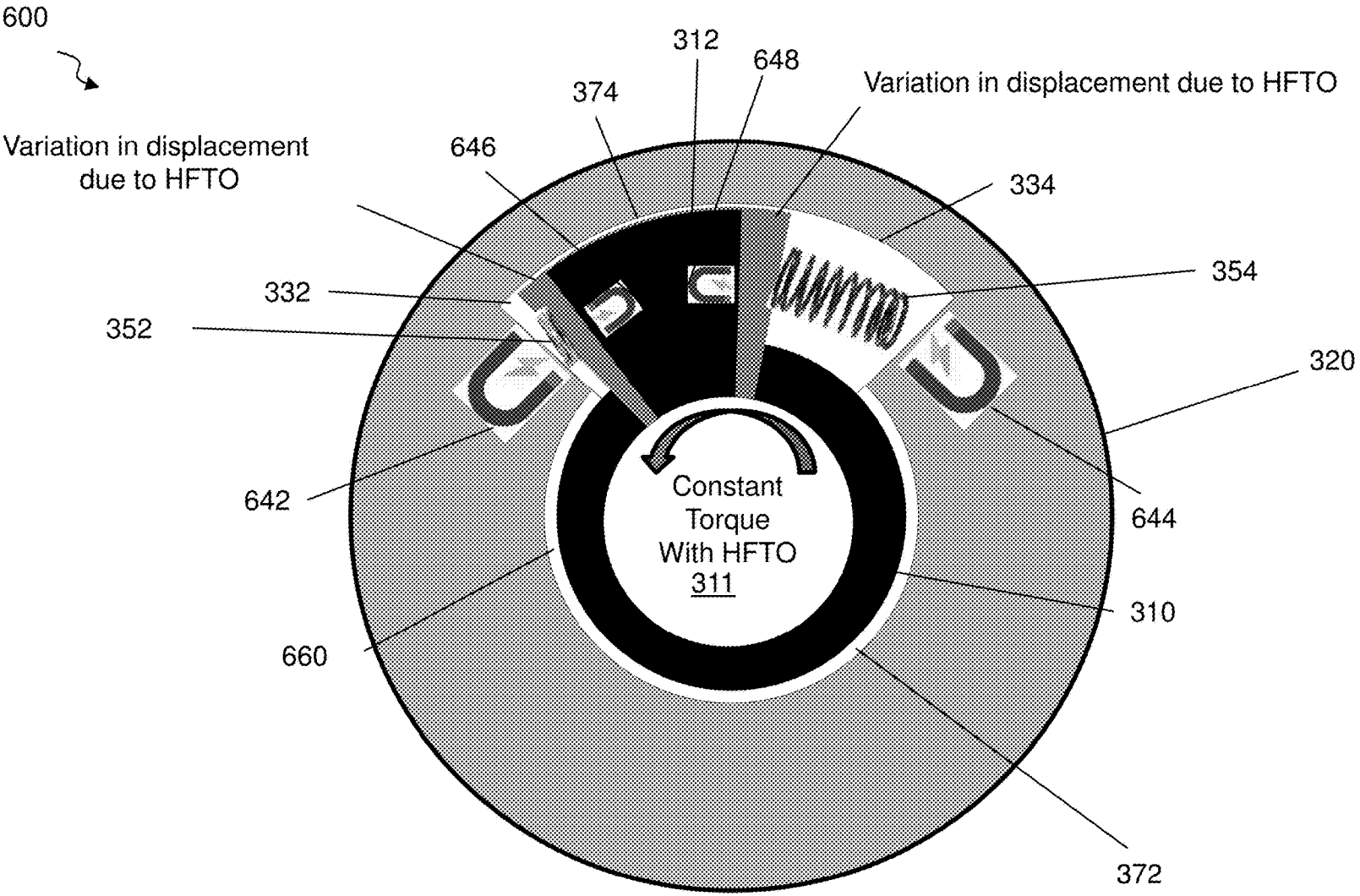
FIG. 8 is an example of the dynamic coupler of FIG. 6 being under the oscillating loads experienced when damaging vibrations occur.

The outer housing includes an internal geometry that creates space allowing relative movement between the inner section and the outer housing within a fluid located within the internal geometry. As such, the inner section is sized and shaped to move within the internal geometry of the outer housing. The fluid can be a smart fluid wherein the viscosity can be changed with the application of an electric or magnetic field. The fluid can be, for example, an electrorheological fluid or a magnetorheological fluid. Fluid paths within dynamic coupler 230 affect the movement of the inner section relative to the outer housing. The fluid paths can be defined by a clearance allowing the relative movement between the inner section and the outer housing. The fluid paths can also be defined or created via other means, such as by fixed orifices. Changing the viscosity of the fluid, the fluid paths, or a combination of both can be used to control the movement of the inner section within the outer housing. FIGS. 3 to 8 illustrate cross sections of examples of dynamic couplers using a fluid wherein the internal geometry of the outer housing includes a central bore with one or more cavities radiating out from the central bore and the inner section includes a central tubular element with one or more tangs extending therefrom. In FIGS. 3 to 8 fluid paths are defined by the clearance allowing movement between the inner section and the outer housing. FIGS. 3 to 5 illustrate examples that use a smart fluid to restrict the movement of the inner section within the outer housing. FIGS. 6 to 8 illustrate examples that do not use a smart fluid but a fluid wherein the viscosity remains unchanged. In other examples that do not use a smart fluid, movement between the inner section and the outer housing can be controlled by another means, such as a variable orifice or valve. A clutch can also be used to restrict movement between the inner section and the outer section in the rigid mode. The processor 220 can be used to control the clutch and operate the orifice or valve to control lubricant movement for the different coupling modes. For example, the processor 220 can control operation of the clutch and the orifice or valve based on sensor measurements that represent vibrations of the BHA, such as HFTO. Accordingly, the dynamic coupler 230 can include movement restrictors such as illustrated and discussed with respect to FIGS. 3 to 8 or include movement restrictors, such as a clutch, or a flow restrictor like an orifice or valve. In another example, the dynamic coupler 230 can be or can include an electric motor with the drill pipe (drill collar) acting as the rotor (e.g., inner section) and the stator (e.g., outer housing) as the stabilizer or upper drill pipe. The processor 220 can control on and off cycling of the electric motor at different frequencies to break up the harmonics from, for example, damaging vibrations such as HFTO.

FIG. 3 is a cross section diagram of an example of a dynamic coupler 300 constructed according to the principles of the disclosure. The dynamic coupler 300 is positioned within a BHA and couples together two portions of the BHA using a fluid. The two portions correspond to a lower portion that includes the drill bit and an upper portion that includes the remaining portion of the BHA above (i.e., the surface side) the dynamic coupler 300. The dynamic coupler 300 includes an inner section 310, an outer housing 320, fluid cavities 332 and 334, electromagnets 342 and 344, springs 352 and 354, and a fluid 360. The inner section 310 is the lower portion of the BHA and the outer housing 320 is the upper portion of the BHA.

The inner section 310 is an example of a central tubular element that is positioned within the outer housing 320 and includes a tang 312 that mates with a recess of a central bore of the outer housing 320. The inner section 310 provides a path 311 for delivering drilling fluid to a drill bit and the tang 312 provides a means of transmitting torque from the outer housing 320 to the inner section 310 through compressible springs, the positive torque spring 352 and the negative torque spring 354. The fluid cavities 332, 334, collectively referred to as fluid cavities 330, are volumes located on each side of the tang 312 within the recess of the outer housing 320. Fluid cavity 332 is a positive torque cavity and fluid cavity 334 is a negative torque cavity. Located within the positive torque cavity 332 and the negative torque cavity 334 are the positive torque spring 352 and the negative torque spring 354, respectively.

In addition to the fluid cavities 330, clearance or volume located between the inner section 310 and the outer housing 320 define a fluid path for a fluid 360 of the dynamic coupler 300 to travel between the fluid cavities 330. A portion of the fluid path 372 is located in the annulus between the inner section 310 and the outer housing 320 and another portion of the fluid path 374 is located in a clearance between a curved portion of the tang 312 and the recess of the outer housing 320. The limited clearance between the tang 312 and the outer housing recess provide a restricted path for the fluid 360 between the fluid cavities 330. The electromagnets 342, 344, are located adjacent to the fluid paths 372 and 374. Electromagnet 342 is located within the tang 312 and electromagnet 344 is located within the outer housing 320. The electromagnets 342 and 344 are controlled by electronic control equipment, such as the processor 220 of FIG. 2.

The positive torque spring 352 and the negative torque spring 354 are installed between the tang 312 and the housing walls of the fluid cavities 330 and centralize the tang 312 within the cavities 330. Under constant torque, a constant displacement of the tang 312 from the nominal position (i.e., centralized position) will be constant. FIG. 4 represents such a condition under constant torque wherein the positive torque spring 352 compresses and displaces the fluid 360 from the positive fluid cavity 332 through the fluid path 374 to the negative fluid cavity 334. The condition of FIG. 4 provides an example of the normal coupling mode wherein switching between different coupling modes is inactive.

Under the oscillating loads experienced when damaging vibrations occur, such as HFTO, displacement of the tang 312 changes as represented in FIG. 5. Essentially, the HFTO applies a variable torque to the BHA that varies the compression in the positive torque spring 352 and the negative torque spring 354 and therefore varies the size of the fluid cavities 330. The displacement of the tang 312 requires the fluid 360 to pass through the fluid path 374 between the fluid cavities 330. As indicated above, the fluid 360 is a smart fluid. Controlling the energization of the electromagnets 342, 344, changes the viscosity of the fluid 360 and assists in changing between the different coupling modes. When the electromagnets 342, 344, are energized, the viscosity of the fluid 360 is increased and the ability for the inner section 310 to move relative to the outer housing 320 is restricted the BHA to behave as a torsionally rigid system, i.e., the rigid coupling mode. With the electromagnets 342, 344, de-energized, the viscosity of the fluid 360 returns to normal and the fluid 360 flows more freely between the cavities 330, i.e., the relaxed coupling mode. Alternating the electromagnets 342, 344, on and off switches the BHA from a more rigid system to a less rigid system and prevents resonance from occurring.

FIG. 6 illustrates a cross section of another example of a dynamic coupler 600 constructed according to the principles of the disclosure. The dynamic coupler 600 includes some features that are the same as those of dynamic coupler 300 and are represented by the same element numbers. In addition to those features, the dynamic coupler 600 includes electromagnets 642, 644, and fluid 660 that is not a smart fluid. In dynamic coupler 600, the electromagnets 642, 644, are utilized to "fix" the position of the inner section 310 within the outer housing 320 or at least severely restrict movement of the inner section 310 rather than use a smart fluid to restrict movement. In the rigid mode, the electromagnets 642, 644, would be energized to hold the inner section 310 in a fixed location relative to the outer housing 320, enabling the BHA to behave as a rigid unit, such as represented in FIG. 7. In the relaxed mode, the electromagnets 642, 644, would be de-energized allowing the inner section 310 to float between the mechanical stops on the internal springs, the positive torque spring 352 and the negative torque spring 354, such as represented in FIG. 6.

Under the oscillating loads experienced when damaging vibrations occur, such as HFTO, displacement of the tang 312 of dynamic coupler 600 changes as represented in FIG. 8. Essentially, the HFTO applies a variable torque to the BHA that varies the compression in the positive torque spring 352 and the negative torque spring 354 and therefore varies the size of the fluid cavities 330. The displacement of the tang 312 requires the fluid 660 to pass through the fluid path 374 between the fluid cavities 330. Controlling the energization of the electromagnets 642, 644, changes the movement of the inner section 310 within the outer housing 320. When the electromagnets 642, 644, are energized, the ability for the inner section 310 to move relative to the outer housing 320 is restricted and the BHA behaves as a torsionally rigid system, i.e., the rigid coupling mode. With the electromagnets 642, 644, de-energized, the inner section 310 moves more freely within the outer housing 320, i.e., the relaxed coupling mode. Alternating the electromagnets 342, 344, on and off switches the BHA from a more rigid system to a less rigid system and prevents resonance from occurring.

The number of electromagnets and the placement of the electromagnets can vary in different implementations. In FIG. 8, a modified dynamic coupler 600 is shown having additional electromagnets 646 and 648 included in the tang 312 of the inner section 310 to provide additional holding force and the ability to repel between the surfaces of the tang 312 and the outer housing 320. The number of electromagnets and the positioning thereof can vary.

Figure 9:
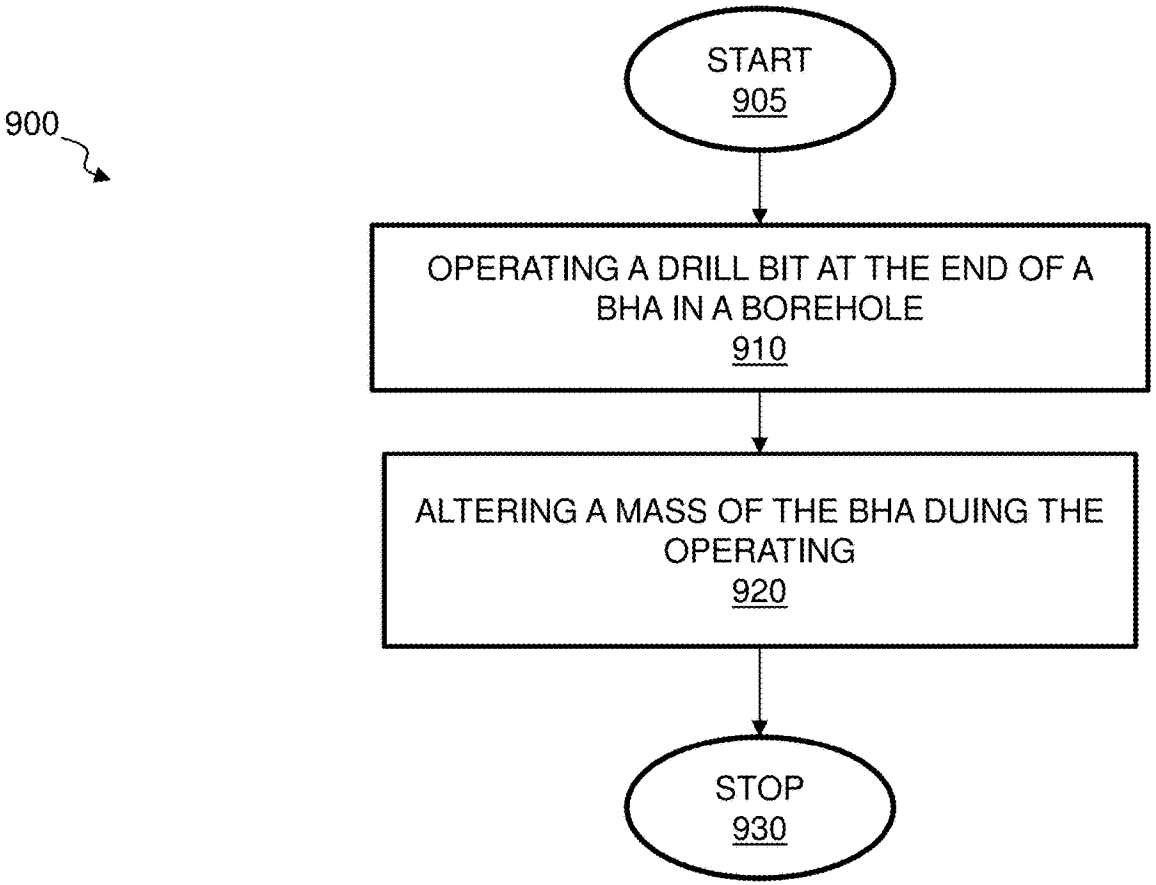
FIG. 9 is a flow diagram of an example method of drilling a wellbore carried out according to the principles of the disclosure.

FIG. 9 is a flow diagram of an example method 900 of drilling a wellbore carried out according to the principles of the disclosure. An ATID as disclosed herein can be used with a BHA in the method 900. The method begins in step 905.

In step 910, a drill bit is operated. The drill bit is located in a wellbore and at the end of the BHA. Drill bit 112 of FIG. 1 provides an example.

In step 920, a mass of the BHA is altered during the operating of the drill bit. The mass can be altered by using the ATID and changing a connection for two portions of the BHA according to two different coupling modes. The changing can include switching between the two different coupling modes using a switching time interval that is less than a resonance time interval for the BHA to achieve a resonance frequency associated with either of the two different coupling modes. The switching time interval can have a variable duty cycle. The different coupling modes can be a rigid mode and a relaxed mode. A torsional rigidity of the BHA is greater in the rigid mode compared to the relaxed mode.

The method 900 continues with operating the drill bit until drilling of the wellbore is complete. Altering of the mass in step 920 can occur multiple time while operating the drill bit. The method 900 ends in step 930 when the drilling is complete.

A portion of the above-described apparatus, systems or methods may be embodied in or performed by various analog or digital data processors, wherein the processors are programmed or store executable programs of sequences of software instructions to perform one or more of the steps of the methods. A processor may be, for example, a programmable logic device such as a programmable array logic (PAL), a generic array logic (GAL), a field programmable gate arrays (FPGA), or another type of computer processing device (CPD). The software instructions of such programs may represent algorithms and be encoded in machine-executable form on non-transitory digital data storage media, e.g., magnetic or optical disks, random-access memory (RAM), magnetic hard disks, flash memories, and/or read-only memory (ROM), to enable various types of digital data processors or computers to perform one, multiple or all of the steps of one or more of the above-described methods, or functions, systems or apparatuses described herein.

Portions of disclosed examples or embodiments may relate to computer storage products with a non-transitory computer-readable medium that have program code thereon for performing various computer-implemented operations that embody a part of an apparatus, device or carry out the steps of a method set forth herein. Non-transitory used herein refers to all computer-readable media except for transitory, propagating signals. Examples of non-transitory computer-readable media include but are not limited to: magnetic media such as hard disks, floppy disks, and magnetic tape; optical media such as CD-ROM disks; magneto-optical media such as floppy disks; and hardware devices that are specially configured to store and execute program code, such as ROM and RAM devices. Configured means, for example, designed, constructed, or programmed, with the necessary logic and/or features for performing a task or tasks. A configured device, therefore, is capable of performing the task or tasks. Examples of program code include both machine code, such as produced by a compiler, and files containing higher level code that may be executed by the computer using an interpreter.

In interpreting the disclosure, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced.

Those skilled in the art to which this application relates will appreciate that other and further additions, deletions, substitutions and modifications may be made to the described embodiments.

Aspects disclosed herein include:

A. An active torsional isolator and damper (ATID) for use with a bottom hole assembly (BHA) having a drill bit, including: (1) a dynamic coupler configured to connect a first portion of the BHA to a second portion of the BHA according to different coupling modes, and (2) a processor configured to control switching of the dynamic coupler between the different coupling modes during a drilling operation of the drill bit.

B. A bottom hole assembly (BHA), including: (1) a drill bit; and (2) an active torsional isolator and damper (ATID) that connects a first portion of the BHA to a second portion of the BHA using a fluid according to different coupling modes and changes a resonance frequency of the BHA by switching between the different coupling modes during drilling by the drill bit, wherein the first portion includes the drill bit.

C. A method of drilling a wellbore, including; (1) operating a drill bit in the wellbore, wherein the drill bit is part of a BHA and (2) altering a mass of the BHA during the operating.

Aspects A, B, and C may have one or more of the following additional elements in combination: Element 1: wherein the different coupling modes include a rigid mode and a relaxed mode, wherein a torsional rigidity of the BHA is greater in the rigid mode compared to the relaxed mode. Element 2: wherein the dynamic coupler includes an inner section located within an outer housing and the processor operates one or more components of the dynamic coupler in the rigid mode to restrict movement of the inner section relative to the outer housing. Element 3: wherein the dynamic coupler includes a smart fluid and the processor operates one or more electromagnets of the dynamic coupler to increase the viscosity of the smart fluid in the rigid mode to restrict the movement of the inner section relative to the outer housing. Element 4: wherein the dynamic coupler includes fluid cavities defined by the inner section and the outer housing and at least one spring in each of the fluid cavities, wherein the processor operates one or more electromagnets of the dynamic coupler to restrict the movement of the inner section relative to the outer housing by changing a volume of the fluid cavities and a compression of the at least one spring. Element 5: wherein the dynamic coupler includes a fluid, fluid cavities defined by the inner section and the outer housing, and a flow controller that controls flow of the fluid between the fluid cavities, wherein the processor operates the flow controller to restrict the movement of the inner section relative to the outer housing in the rigid mode. Element 6: wherein the dynamic coupler includes a clutch and the processor operates the clutch to restrict the movement of the inner section relative to the outer housing in the rigid mode. Element 7: wherein the dynamic coupler includes electromagnets operable by the processor, permanent magnets, or a combination thereof that assist in restricting the movement of the inner section relative to the outer housing in the rigid mode. Element 8: wherein the dynamic coupler includes an outer housing, an inner section, fluid cavities defined by the outer housing and the inner section, and fluid located in the fluid cavities that couples the inner section to the outer housing, wherein the inner section corresponds to the first portion of the BHA, the outer housing corresponds to the second portion of the BHA, and the first portion includes the drill bit. Element 9: wherein the processor is configured to switch between the different coupling modes using a switching time interval that is less than a resonance time interval for the BHA to achieve a resonance frequency associated with either of the different coupling modes. Element 10: wherein the switching time interval is fixed. Element 11: wherein one of the different coupling modes includes a normal mode, wherein the processor does not switch between the different coupling modes in the normal mode. Element 12: wherein the ATID includes a dynamic coupler configured to connect the first and second portions of the BHA, wherein one or more components of the dynamic coupler are changed when switching between the two different coupling modes. Element 13: wherein the dynamic coupler includes an outer housing, an inner section, fluid cavities defined by the outer housing and the inner section, and the fluid located in the fluid cavities that couples the inner section to the outer housing, wherein the inner section corresponds to the first portion of the BHA and the outer housing corresponds to the second portion of the BHA. Element 14: wherein the components include one or more of the fluid, fluid cavities, springs located in the fluid cavities, a flow controller for the fluid, a clutch, or one or more of electromagnets. Element 15: wherein the ATID further includes a processor configured to control the switching of the dynamic coupler between the different coupling modes during the drilling by the drill bit. Element 16: wherein the processor is configured to switch between the different coupling modes using a switching time interval that is less than a resonance time interval for the BHA to achieve a resonance frequency associated with either of the different coupling modes. Element 17: wherein a duty cycle of the switching time interval varies. Element 18: wherein the altering includes changing a connection between two different portions of the BHA according to two different coupling modes. Element 19: wherein the changing includes switching between the two different coupling modes using a switching time interval that is less than a resonance time interval for the BHA to achieve a resonance frequency associated with either of the different coupling modes. Element 20: wherein the two different coupling modes include a rigid mode and a relaxed mode, wherein a torsional rigidity of the BHA is greater in the rigid mode compared to the relaxed mode.

What is claimed is:

1. A bottom hole assembly (BHA), comprising:

a drill bit; and an active torsional isolator and damper (ATID) that connects a first portion of the BHA to a second portion of the BHA using a fluid according to different coupling modes and changes a resonance frequency of the BHA by switching between the different coupling modes during drilling by the drill bit according to a switching time interval that is less than a resonance time interval for the BHA to achieve a resonance frequency associated with either of the different coupling modes, wherein the first portion includes the drill bit and the different coupling modes include at least one coupling mode that restricts torsional movement between the first portion relative to the second portion, wherein a duty cycle of the switching time interval varies based on a signature of the resonance frequency.

2. The BHA as recited in claim 1, wherein the ATID includes a dynamic coupler configured to connect the first and second portions of the BHA, wherein one or more components of the dynamic coupler are changed when switching between the different coupling modes.

3. The BHA as recited in claim 2, wherein the one or more components include an outer housing, an inner section, and fluid cavities defined by the outer housing and the inner section, wherein the fluid is located in the fluid cavities and couples the inner section to the outer housing, wherein the inner section corresponds to the first portion of the BHA and the outer housing corresponds to the second portion of the BHA.

4. The BHA as recited in claim 3, wherein the one or more components include electromagnets operable by the processor, permanent magnets, or a combination thereof that assist in restricting the torsional movement of the inner section relative to the outer housing in a rigid mode.

5. The BHA as recited in claim 2, wherein the one or more components include one or more of the fluid, fluid cavities, springs located in the fluid cavities, a flow controller for the fluid, a clutch, or one or more of electromagnets.

6. The BHA as recited in claim 2, wherein the ATID further includes a processor configured to control the switching of the dynamic coupler between the different coupling modes during the drilling by the drill bit.

7. The BHA as recited in claim 6, wherein the one or more components include one or more electromagnets, the dynamic coupler includes a smart fluid, and the processor is configured to operate the one or more electromagnets to increase viscosity of the smart fluid to restrict the torsional movement.

8. A method of drilling a wellbore, comprising:

operating a drill bit in the wellbore, wherein the drill bit is part of a BHA; and altering a mass of the BHA during the operating according to different coupling modes, wherein one of the different coupling modes restricts torsional movement of an inner section of the BHA relative to an outer section of the BHA and at least a portion of the inner section is located within at least a portion of the outer section, wherein the altering includes switching between the different coupling modes using a switching time interval that is less than a resonance time interval for the BHA to achieve a resonance frequency associated with either of the different coupling modes and is variable based on an indication of resonance in either of the different coupling modes.

9. The method as recited in claim 8, wherein the altering includes changing a connection between the inner section and the outer section according to the different coupling modes.

10. The method of drilling as recited in claim 9, wherein the altering includes using one or more magnets to assist in changing the connection between the inner section and the outer section according to the different coupling modes.

11. The method of drilling as recited in claim 9, wherein the different coupling modes include a rigid mode and a relaxed mode, wherein a torsional rigidity of the BHA is greater in the rigid mode compared to the relaxed mode.

* * * * *